US005214405A

United States Patent [19]

Glas

[11] Patent Number: 5,214,405

[45] Date of Patent: May 25, 1993

[54] MINIATURE CIRCUIT-BREAKER WITH REMOTE TRIPPING

[75] Inventor: Anton Glas, Regensburg, Fed. Rep. of Germany

[73] Assignee: Siemens Aktiengesellschaft, Munich, Fed. Rep. of Germany

[21] Appl. No.: 884,029

[22] Filed: May 18, 1992

[30] Foreign Application Priority Data

May 17, 1991 [EP] European Pat. Off. ..... 91108041.4

[51] Int. Cl.[5] ..... H01H 71/16; H01H 61/02

[52] U.S. Cl. ..... 337/71; 337/77

[58] Field of Search ..... 337/70, 71, 75, 77, 337/79, 341, 95, 96

[56] References Cited

U.S. PATENT DOCUMENTS

| | | | |
|---|---|---|---|
| 3,614,698 | 10/1971 | Gardner | 337/341 |
| 3,840,834 | 10/1974 | Obenhaus et al. | 337/79 |
| 4,616,206 | 10/1986 | Bridges et al. | 337/71 |

FOREIGN PATENT DOCUMENTS

| | | | |
|---|---|---|---|
| 0735839 | 5/1943 | Fed. Rep. of Germany . | |
| 1513256 | 10/1969 | Fed. Rep. of Germany . | |
| 7327063 | 12/1973 | Fed. Rep. of Germany . | |
| 0717394 | 5/1931 | France . | |
| 803225 | 9/1936 | France | 337/77 |
| 1538706 | 9/1968 | France . | |

*Primary Examiner*—Harold Broome

*Attorney, Agent, or Firm*—Kenyon & Kenyon

[57] ABSTRACT

A miniature circuit-breaker includes at least one thermal trip element, which includes a force translator which causes switching contacts to open. The force translator may be a breaker mechanism. The thermal trip element works with a thermally sensitive element, in particular a bimetal trip element, which is in thermally conductive contact with a PTC (positive temperature coefficient) thermistor. The PTC thermistor is connected to a voltage allocated to properly heat the thermally sensitive element causing it to respond. In this manner, the voltage can be applied through remote tripping.

6 Claims, 1 Drawing Sheet

MINIATURE CIRCUIT-BREAKER WITH REMOTE TRIPPING

BACKGROUND OF THE INVENTION

The present invention relates to a miniature circuit-breaker which works with at least one thermal trip element. This is also understood to include other circuit-breakers which work with at least one thermal trip element. These types of miniature circuit-breakers are found on the market in many different kinds of designs. As a rule, they work with a breaker mechanism, which can usually be released by a magnetic trip element and by a thermal trip element to allow the switching contacts to open. The electric arc that is struck is usually extinguished in an arcing chamber.

SUMMARY OF THE INVENTION

The present invention provides a miniature circuit-breaker in which remote tripping is realized in a particularly simple manner.

The present invention includes a thermal trip element having a thermally sensitive element which is in thermally conductive contact with a PTC (positive temperature coefficient) thermistor. The PTC thermistor is able to be connected to a voltage allocated to properly heat the thermally sensitive element causing it to respond. The thermal trip element can be designed simply as a bimetal trip element. It is also possible to use another force translator in place of the breaker mechanism.

When the allocated voltage is applied to the PTC thermistor through remote tripping, the PTC thermistor is heated to a value which causes the thermal trip element to respond. When a bimetal trip element is used, the deflection which follows suffices, in the case of a breaker mechanism, to allow a latch to slide down from the latching position and to release the breaker mechanism. The remote tripping can be effected by means of a component, which works according to the action principle of a relay in the miniature circuit-breaker, or through the external application of a suitable voltage to the PTC thermistor.

After reaching its trigger temperature, at which its resistance rises abruptly, the PTC thermistor takes care of restricting the supply of energy to the thermal trip element.

The PTC thermistor can be secured to the bimetal trip element by means of a clip.

BRIEF DESCRIPTION OF THE DRAWING

The present invention shall now be clarified in greater detail on the basis of an exemplary embodiment illustrated in FIG. 1.

DETAILED DESCRIPTION

Figure 1:
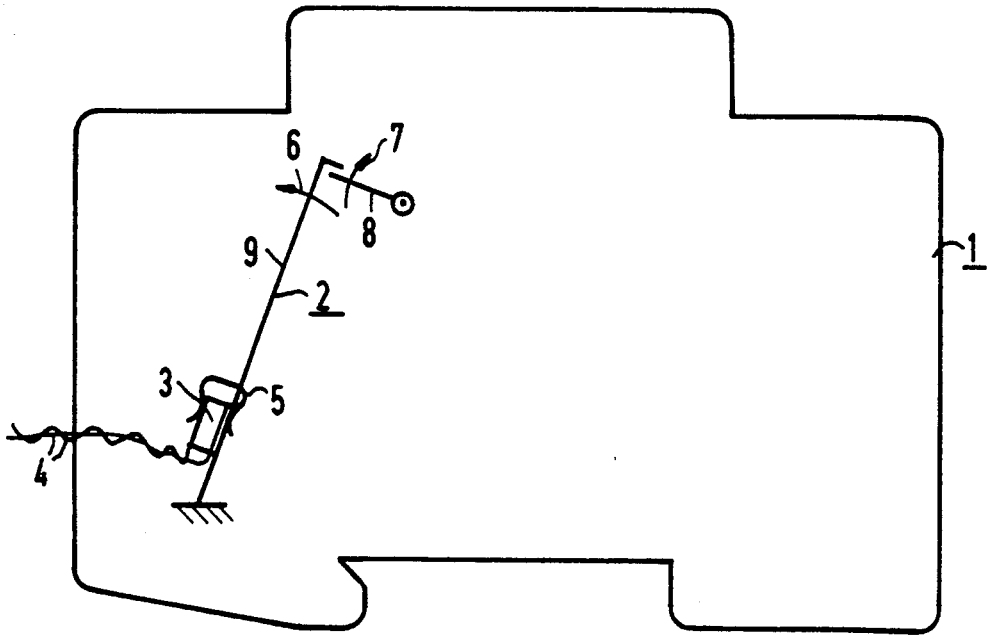

A miniature circuit-breaker 1 works with a thermal trip element 2, which in the illustrated embodiment is a bimetal trip element designed as a thermally sensitive element 9. A PTC thermistor 3 is in thermally conductive contact with this element. A voltage allocated for proper heating can be applied by means of connecting leads 4 to the PTC thermistor 3. The PTC thermistor 3 is secured to the bimetal trip element by means of a retaining clip 5. When the bimetal portion of the thermal trip element 2 deflects at the response temperature in the deflection direction 6, a latch 8 can be released under the influence of the releasing force 7.

The miniature circuit-breaker according to the present invention makes it possible to implement a remote tripping with a simple construction. For this purpose, one can utilize the subassemblies that are customarily available. After the cut-off point of the PTC thermistor is reached, only a small power requirement exists, whereby a self-protection feature is made available for the tripping device. The thermal trip element is suited for a remote tripping through AC voltage or through DC voltage. When AC voltage is applied to the PTC thermistor, one avoids the magnetic hum which is customary in magnetic trip elements that are set up for remote tripping.

What is claimed is:

1. A miniature circuit-breaker comprising:

a thermal trip element including a force translator which causes switching contacts to open, wherein the thermal trip element is a thermally sensitive element;

a PTC (positive temperature coefficient) thermistor in thermally conductive contact with said thermally sensitive thermal trip element; and an external signal path connected to the PTC thermistor providing a voltage to the PTC thermistor to properly heat the thermally sensitive thermal trip element causing it to respond.

2. The miniature circuit-breaker according to claim 1, wherein said thermally sensitive element is a bimetal trip element.

3. The miniature circuit-breaker according to claim 2, further comprising a retaining clip which secures the PTC thermistor to the bimetal trip element.

4. The miniature circuit-breaker according to claim 1, wherein said force translator is a breaker mechanism.

5. The miniature circuit-breaker according to claim 1, wherein said voltage is an AC voltage.

6. The miniature circuit-breaker according to claim 1, wherein said PTC thermistor is electrically insulated from said thermally sensitive thermal trip element.

* * * * *